US009875685B2

(12) United States Patent
Kwon et al.

(10) Patent No.: US 9,875,685 B2
(45) Date of Patent: Jan. 23, 2018

(54) DISPLAY DEVICE AND METHOD FOR COMPENSATION OF IMAGE DATA OF THE SAME

(71) Applicant: SAMSUNG DISPLAY CO., LTD., Yongin, Gyeonggi-Do (KR)

(72) Inventors: Oh-Jo Kwon, Yongin (KR); Won-Tae Choi, Yongin (KR); Choong-Sun Shin, Yongin (KR); Jeong-Kyoo Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 780 days.

(21) Appl. No.: 13/932,982

(22) Filed: Jul. 1, 2013

(65) Prior Publication Data

US 2014/0253603 A1 Sep. 11, 2014

(30) Foreign Application Priority Data

Mar. 11, 2013 (KR) ..... 10-2013-0025739

(51) Int. Cl.
*G09G 3/3233* (2016.01)
*G09G 3/3208* (2016.01)

(52) U.S. Cl.
CPC ... *G09G 3/3208* (2013.01); *G09G 2320/0233* (2013.01); *G09G 2320/0285* (2013.01); *G09G 2320/045* (2013.01)

(58) Field of Classification Search
CPC ..... G09G 3/3208; G09G 2320/0233; G09G 2320/0285; G09G 2320/045
See application file for complete search history.

(56) References Cited

U.S. PATENT DOCUMENTS 8,502,811 B2 * 8/2013 Ogura ..... G09G 3/20 345/211
9,177,509 B2 * 11/2015 Kerofsky ..... G09G 3/3426
2002/0149598 A1 * 10/2002 Greier ..... G09G 3/3611 345/589

(Continued)

FOREIGN PATENT DOCUMENTS

JP 2005-316408 A 11/2005
KR 10-2005-0033297 4/2005

(Continued)

*Primary Examiner* — Jose Soto Lopez
(74) *Attorney, Agent, or Firm* — Lewis Roca Rothgerber Christie LLP

(57) ABSTRACT

A display device includes: a display including a plurality of pixels; and a controller configured to: receive an external input image signal, adjust the external input image signal to compensate for brightness deviations of the pixels, and transmit corresponding image data signals to the pixels, wherein the controller includes: a data input section configured to receive the external input image signal and transmit a test image data signal to the pixels through a data driver, a luminance information extracting section configured to: extract brightness information for the pixels after displaying a test image in accordance with the test image data signal, and calculate first, second, and third parameters, using the brightness information, and a data compensating section configured to generate the image data signals by adjusting the external input image signal based on the first, second, and third parameters.

10 Claims, 4 Drawing Sheets

(56) References Cited

U.S. PATENT DOCUMENTS

2005/0083355 A1* 4/2005 Tezuka ..... G06T 3/403 345/694
2006/0097971 A1* 5/2006 Lee ..... G09G 3/3648 345/89
2006/0214940 A1* 9/2006 Kinoshita ..... G09G 3/2096 345/589
2008/0143753 A1* 6/2008 Ou-Yang ..... G09G 3/006 345/690
2008/0204438 A1* 8/2008 Song ..... G09G 3/3225 345/207
2009/0115907 A1* 5/2009 Baba ..... G09G 3/3406 348/672
2009/0141167 A1* 6/2009 Zhang ..... G09G 5/02 348/455
2009/0160740 A1* 6/2009 Leon ..... G09G 3/3291 345/76
2009/0167644 A1* 7/2009 White ..... G09G 3/3233 345/76
2010/0007599 A1* 1/2010 Kerofsky ..... G09G 3/3413 345/102
2010/0045650 A1* 2/2010 Fish ..... G09G 3/3258 345/211
2010/0053222 A1* 3/2010 Kerofsky ..... G09G 3/3406 345/690
2010/0073265 A1* 3/2010 Hirai ..... G09G 3/3241 345/55
2010/0141559 A1* 6/2010 Hwang ..... G09G 5/003 345/58
2010/0177125 A1* 7/2010 Miwa ..... G09G 3/3233 345/690
2010/0253706 A1* 10/2010 Shirouzu ..... G09G 3/2092 345/690
2010/0265266 A1* 10/2010 Liu ..... G09G 5/02 345/600
2011/0007102 A1* 1/2011 Ogura ..... G09G 3/3233 345/690
2011/0074664 A1* 3/2011 Lebrun ..... G09G 3/006 345/98
2011/0157134 A1* 6/2011 Ogura ..... G09G 3/20 345/211
2011/0191042 A1* 8/2011 Chaji ..... G09G 3/32 702/64
2011/0199395 A1* 8/2011 Nathan ..... G09G 3/3241 345/690
2011/0210958 A1* 9/2011 Yoo ..... G09G 3/325 345/214
2011/0227941 A1* 9/2011 Huang ..... H04N 1/6027 345/596
2011/0285763 A1* 11/2011 Bassi ..... G06T 5/008 345/694
2012/0081381 A1* 4/2012 Kobayashi ..... G09G 5/18 345/558
2012/0105502 A1* 5/2012 Yokoyama ..... G09G 3/20 345/690
2012/0147070 A1* 6/2012 Segawa ..... G09G 3/006 345/694
2012/0154453 A1* 6/2012 Yamashita ..... G09G 3/3225 345/690
2012/0162285 A1* 6/2012 Yamashita ..... G09G 3/32 345/690
2012/0293400 A1* 11/2012 Matsubayashi ..... G09G 3/3406 345/88
2012/0299973 A1* 11/2012 Jaffari ..... G09G 3/3208 345/690
2013/0201223 A1* 8/2013 Li ..... G09G 3/2022 345/690
2013/0229443 A1* 9/2013 Kuroki ..... G09G 3/20 345/690
2014/0055500 A1* 2/2014 Lai ..... G09G 3/3208 345/690
2014/0118409 A1* 5/2014 Jun ..... G09G 5/02 345/690
2014/0152642 A1* 6/2014 Kim ..... G09G 3/3233 345/212
2014/0152718 A1* 6/2014 Kwak ..... G09G 5/10 345/691
2014/0375700 A1* 12/2014 Takahama ..... G09G 3/3208 345/690
2016/0005350 A1* 1/2016 Chaji ..... G09G 3/3208 345/694

FOREIGN PATENT DOCUMENTS

KR 10-2010-0056714 5/2010
KR 10-2010-0114736 10/2010

* cited by examiner

DISPLAY DEVICE AND METHOD FOR COMPENSATION OF IMAGE DATA OF THE SAME

CROSS-REFERENCE TO RELATED APPLICATION

This application claims priority to and the benefit of Korean Patent Application No. 10-2013-0025739, filed in the Korean Intellectual Property Office on Mar. 11, 2013, the entire content of which is incorporated herein by reference.

BACKGROUND

1. Field

Aspects of the present invention relate to a display device including an image compensation device and a method of compensating for an image of a display device using the same.

2. Description of the Related Art

Recently, various kinds of flat panel displays have been developed and used. An LCD (Liquid Crystal Display) and an OLED (Organic Light Emitting Diode) display device are examples of flat panel displays. For example, the OLED display device displays an image, using an OLED or a WOLED (White Organic Light Emitting Diode), which are self-emission devices that cause fluorescent materials to emit light, using recombination of electrons and holes. Accordingly, the OLED display device has a response speed, which is relatively faster than that of a passive light emitting device requiring a separate light source such as a liquid crystal display, and a low DC driving voltage, and can be manufactured in an ultrathin size such that it is utilized for a wall-hanging display device or a cell phone.

Those display devices all implement a function of regulating brightness (luminance) of image data by arranging and controlling pixels, using AM (Active-Matrix) or PM (Passive-Matrix).

The pixels are usually arranged on a 2D plane and driven so that it is possible to control the pixels at desired positions by sequentially selecting rows and columns, and it is possible to display an accurate and clear image by regulating luminance (brightness) data of the pixels.

In general, in the AM type, it is possible to select the row and column of a pixel, using a Thin Film Transistor (TFT). However, because the threshold voltages of TFTs included in a plurality of pixels in the same display panel may vary between TFTs, the pixels display light at different threshold voltages, even if the same image data is inputted, such that the brightness of the pixels may not be uniform between pixels.

Because the LCD uses a voltage driving mechanism, even if the same voltage is applied, the relative brightness between pixels may not be uniform, due to differences or variances in the features of the liquid crystal elements.

Further, the OLED display also has a problem in that the brightness may not be uniform, even if the same current is applied, due to a difference in emission efficiency of the light emitting elements.

Therefore, there is demand to develop a display device that can implement an accurate image by removing or reducing non-uniformity of a screen due to the difference in luminance of pixels, and a driving method that can provide a compensation effect for an image.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed toward an image compensation device having relatively improved non-uniformity of the luminance of a display panel and relatively increased compensation accuracy for image data, and a display device using the compensation device.

Aspects of embodiments of the present invention are directed toward an image data compensation processing method, which can remove or reduce non-uniformity of luminance of a display device, regardless of external brightness conditions of the display device.

An embodiment of the present invention provides a display device including: a controller configured to: receive an external input image signal, adjust the external input image signal to compensate for brightness deviations of the pixels, and transmit corresponding image data signals to the pixels, wherein the controller comprises: a data input section configured to receive the external input image signal and transmit a test image data signal to the pixels through a data driver, a luminance information extracting section configured to: extract brightness information for the pixels after displaying a test image in accordance with the test image data signal, and calculate first, second, and third parameters, using the brightness information, and a data compensating section configured to generate the image data signals by adjusting the external input image signal based on the first, second, and third parameters.

The brightness information may include luminance information, color temperature, and color coordinate information corresponding to one of the pixels that displays the test image in response to the test image data signal.

The first parameter may correspond to luminous efficiency of light emitting elements of the pixels, the second parameter may correspond to a threshold voltage deviation of driving transistors of the pixels, and the third parameter may correspond to a change in brightness of the display, the change in brightness generated by a driving technique and an error in driving factors of the display.

The controller may further include a compensation data storing section configured to store compensation information comprising brightness information of the pixels and the first, second, and third parameters.

The compensation data storing section may include: a memory configured to: store the compensation information, transmit the compensation information to a data compensating section, receive an image data signal adjusted by the data compensating section, and store a look-up table of parameters for adjusting image data in the compensation information, and a memory controller configured to control the memory.

The data compensating section may be configured to adjust the external input image signal by sequentially applying the first parameter, the second parameter, and the third parameter.

The luminance information extracting section may include: a first parameter extracting unit, a second parameter extracting unit, and a third parameter extracting unit, which are configured to select one of the pixels and calculate the first, second, and third parameters, respectively, based at least partially on the brightness information of the one of the pixels, wherein the second parameter extracting unit is configured to calculate the second parameter based on the brightness information of at least three of the pixels, the third parameter extracting unit is configured to calculate the third parameter based on the second parameter, and the first parameter extracting unit is configured to calculate the first parameter based on the second and third parameters.

Another embodiment of the present invention provides an image compensation method of a display device, the display device including a display comprising a plurality of pixels; and a controller configured to receive an external input image signal, compensate for the external input image signal, and transmit corresponding image data signals to each of the pixels, the method comprising: transmitting a test image data signal to the pixels through a data driver; displaying a test image using the pixels in response to the test image data signal; selecting a group of the pixels; acquiring brightness information for the group of the pixels displaying the test image; calculating a first parameter, a second parameter, and a third parameter, using the brightness information; and generating the image data signals by adjusting the external input image signal based on the first, second, and third parameters.

In one embodiment, the brightness information includes luminance information, color temperature, and color coordinate information corresponding to the group of the pixels that displays the test image in response to the test image data signal.

The first parameter may correspond to luminous efficiency of light emitting elements of the pixels, the second parameter may correspond to a threshold voltage deviation of driving transistors of the pixels, and the third parameter may correspond to a change in of the display, the change in brightness generated by a driving technique and an error in driving factors of the display.

The method may further include storing compensation information comprising the brightness information, the first, second, and third parameters, and the image data signal generated by adjusting the external input image signal.

The method may further include adjusting the external input image signal by sequentially applying the first parameter, the second parameter, and the third parameter.

The calculating of first to third parameters may include: selecting one of the pixels and calculating the second parameter from the brightness information for the selected one of the pixels, calculating the third parameter based on the second parameter, and calculating the first parameter based on the second and third parameters.

According to a display device and an image compensation method of the display device of embodiments of the present invention, it is possible to compensate for brightness deviation of a displayed image due to various reasons, such that it is possible to stably improve non-uniformity of luminance of the display device. Therefore, according to an embodiment of the present invention, it is possible to achieve a compensation logic that can be simply and effectively applied to a display device requiring high resolution, to produce a high-quality display device, and to improve product quality with the yield increased.

DETAILED DESCRIPTION

Figure 1:
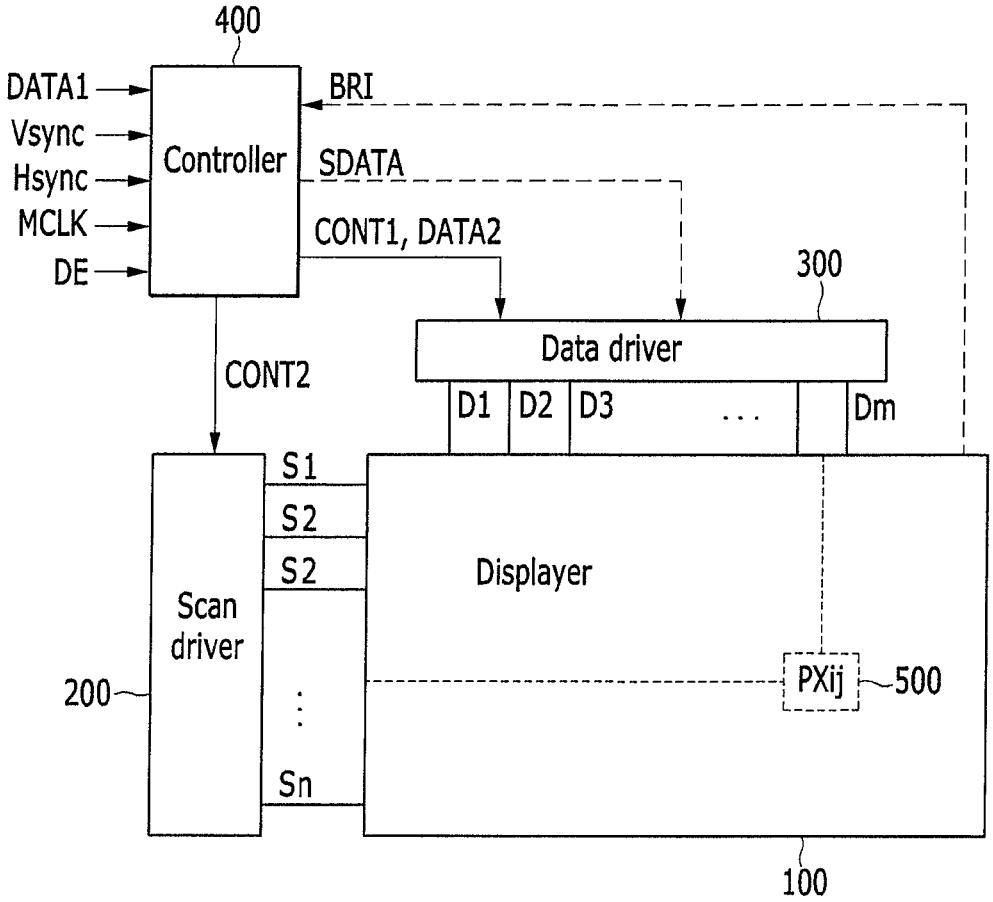
FIG. 1 is a block diagram illustrating the schematic configuration of a display device according to an embodiment of the present invention.

Hereinafter, embodiments of the present invention will be described in detail with reference to the accompanying drawings such that those skilled in the art can easily achieve the present invention. The present invention may be implemented in various ways and is not limited to the embodiments described herein.

The unrelated parts to the description of the embodiments are not shown to make the description clear and like reference numerals designate like element throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram illustrating the schematic configuration of a display device according to an embodiment of the present invention.

Referring to FIG. 1, a display device includes a displayer or display 100 including a plurality of pixels 500, a scan driver 200, a data driver 300, and a controller 400.

The display 100 includes a plurality of pixels 500 coupled to corresponding scan lines in a plurality of scan lines S1-Sn and with corresponding data lines in a plurality of data lines D1-Dm. The pixels display an image in response to image data signals transmitted to the pixels, respectively.

The pixels in the display 100 are coupled to the scan lines S1-Sn and the data lines D1-Dm and arranged substantially in a matrix shape. The scan lines S1-Sn extend substantially in the row (i.e., horizontal) direction and are substantially parallel with each other. The data lines D1-Dm extend substantially in the column (i.e., vertical) direction and are substantially parallel with each other. The pixels in the display 100 are driven by a driving power source voltage from an external power supply.

The scan driver 200 is coupled to the display 100 through the scan lines S1-Sn. The scan driver 200 generates a plurality of scan signals that can activate the pixels in the display 100 in response to a scan control signal CONT2 and transmits the scan signals to corresponding scan lines in the scan lines S1-Sn.

The scan control signal CONT2 is a signal for controlling the operation of the scan driver 200 which is generated and transmitted by the controller 400. The scan control signal CONT2 may include a scan start signal and a clock signal. The scan start signal is a signal generating the first scan signal for displaying an image of one frame. The clock signal is a synchronization signal for sequentially supplying scan signals to the scan lines S1-Sn.

The data driver 300 is coupled to the pixels in the display 100 through the data lines D1-Dm.

The data driver 300 receives image data signals DATA2 and transmits them to corresponding data lines in the data lines D1-Dm in response to a data control signal CONT1. The image data signals DATA2 are data obtained by compensating for brightness deviation of an external input video or image signal DATA1 inputted from an external image source. The image data signal DATA2 is referred to as a compensation data signal hereafter.

The data driver 300 according to an embodiment of the present invention may receive a test image data signal SDATA for compensation of luminance deviation from the controller 400 and then transmit a corresponding test data voltage to the pixels in the display 100, before an image is displayed by transmitting a data voltage according to the compensation data signal DATA to the pixels in the display 100.

Then, the pixels display a test image according to the test image data signal SDATA, brightness information BRI for each pixel is extracted from the test images, and the controller 400 generates and transmits a compensation data signal DATA2 to the data driver 300 by processing an external video signal for each pixel.

The data control signal CONT1 is a signal for controlling the operation of the data driver 300 which is generated and transmitted by the controller 400. Though not shown in detail in FIG. 1, the data control signal CONT1 may include not only an operation control signal for processing the compensation data signal DATA2 according to a video signal inputted from an external image source in the data driver 300, but an operation control signal allowing control of the operation of processing the test image data signal SDATA for collecting the brightness deviation information of the display 100.

The data driver 300 selects a gray voltage according to the compensation data signal DATA2 processed with an image and finally outputted from the controller 400, and transmits the gray voltage to the data lines D1-Dm.

The controller 400 receives an external input image signal DATA1 inputted from an external source and an input control signal for controlling display of the image signal. The external input image signal DATA1 carries the luminance of the pixels in the display 100, and the luminance has a value (e.g., a predetermined value) of; for example, $1024=2^{10}$, $256=2^{8}$, or $64=2^{6}$ grayscales (grays). The external input image signal DATA1 undergoes an image processing process for the luminance data including the luminance information through an image compensation device included in the controller 400, and the compensation data signal DATA2 is transmitted to the data driver 300.

The input control signal transmitted to the controller 400 is, for example, a vertical synchronization signal Vsync, a horizontal synchronization signal Hsync, a main clock MCLK, and a data enable signal DE.

The controller 400 performs image processing on an external input image signal DATA1 on the basis of the external input image signal DATA1 and the input control signal to fit the operation conditions of the display 100 and the data driver 300. A compensation processing process for the brightness deviation of the pixels in the display 100 is included in the image processing process. The detailed image processing process of the controller 400 will be described with reference to the following drawings.

Further, the controller 400 transmits a scan control signal CONT2 for controlling the scan driver 200 to the scan driver 200. The controller 400 generates a data control signal CONT1 for controlling the operation of the data driver 300.

Figure 2:
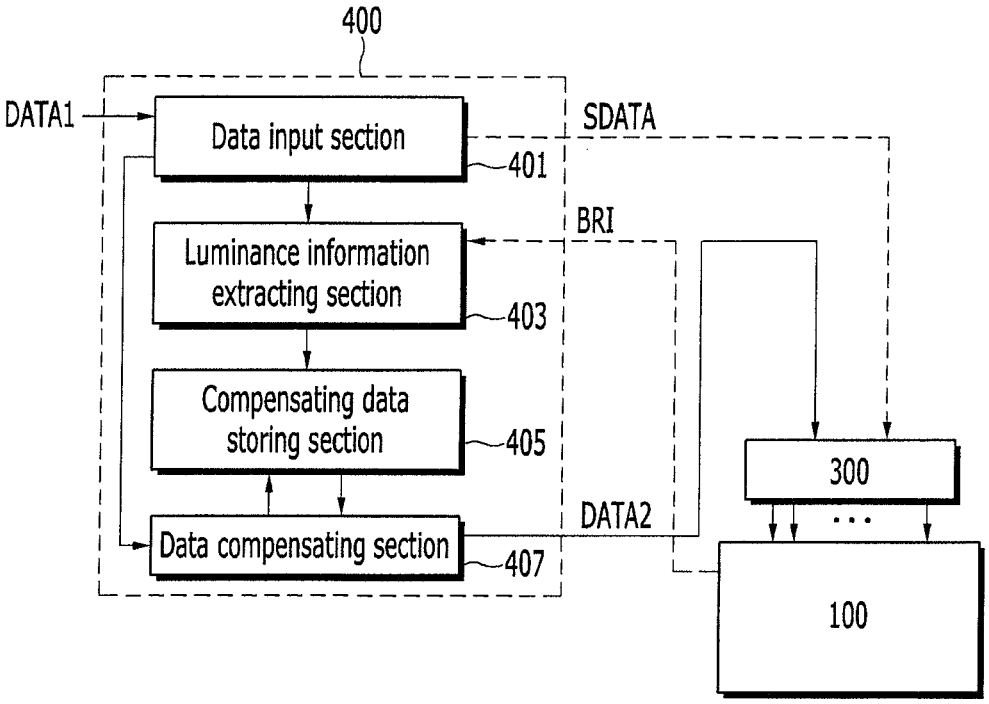
FIG. 2 is a block diagram schematically illustrating the configuration of an image compensation device of a display device according to an embodiment of the present invention, which is included in a controller of the display device of FIG. 1.

FIG. 2 is a block diagram schematically illustrating the configuration of an image compensation device of a display device according to an embodiment of the present invention, which is included in the controller 400 of the display device of FIG. 1.

An image compensation device of the display device according to the embodiment of FIG. 2 is included in the controller 400, but it is not limited thereto and may be a separate device outside of or external with respect to the driving circuit of the display device.

The image compensation device according to the embodiment of FIG. 2 includes a data input section 401, a luminance information extracting section 403, a compensation data storing section 405, and a data compensating section 407.

The data input section 401 receives an external input image signal DATA1 inputted from an external source. The data input section 401 can use some of the external input image signal DATA1 as test image data (e.g., predetermined test image data) signals SDATA, and the test image data signals SDATA are transmitted to the data driver 300 to compensate for luminance deviation according embodiments of to the present invention. The data input section 401 may transmit an external input image signal DATA1 to the data compensating section 407 to compensate for the luminance deviation.

The data input section 401 receives and transmits, in real time, the external input image signal DATA1 from an external source, but may be designed such that the test image data signal SDATA is regularly transmitted (e.g., at each predetermined time) in order to give compensation intervals (e.g., predetermined compensation intervals) or is transmitted in accordance with settings implemented by a user of the display device.

As shown in FIG. 2, the test image data (e.g., predetermined test image data) signal SDATA directly transmitted through the data input section 401 is transmitted, as data that has not undergone the compensation according to an embodiment of the present invention, to the data driver 300. Accordingly, it changes into a test image data voltage (e.g., a predetermined test image data voltage) through the data driver 300 and then is transmitted to the pixels in the display 100. Then, the pixels in the display 100 are driven to display a test image according to the test image data signal SDATA and the brightness information BRI of the pixels is transmitted to the luminance information extracting section 403 of the controller 400.

The brightness information BRI extracted for each of the pixels may include information such as luminance information, color temperature, and color coordinates according to test image data signals of pixels having red R, green G, and blue B organic light emitting diodes or WOLEDs (White Organic Light Emitting Diode). For example, the external input image signal DATA1 inputted from an external source may be implemented by image data of 8 bits corresponding to the pixels, respectively, and can express brightness of 256 grayscale, such that the test image data signal SDATA can be implemented as 8 bit data transmitted to the red R, green G, and blue B pixels and express brightness of 256 grayscale. The test image data signal SDATA may include at least three grayscale data values within the grayscale range for one pixel. Therefore, for one pixel, the brightness information BRI may include luminance data extracted by sensing light emitted by the pixel, corresponding to the grayscale values of at least three test image data signals SDATA.

Figure 3:
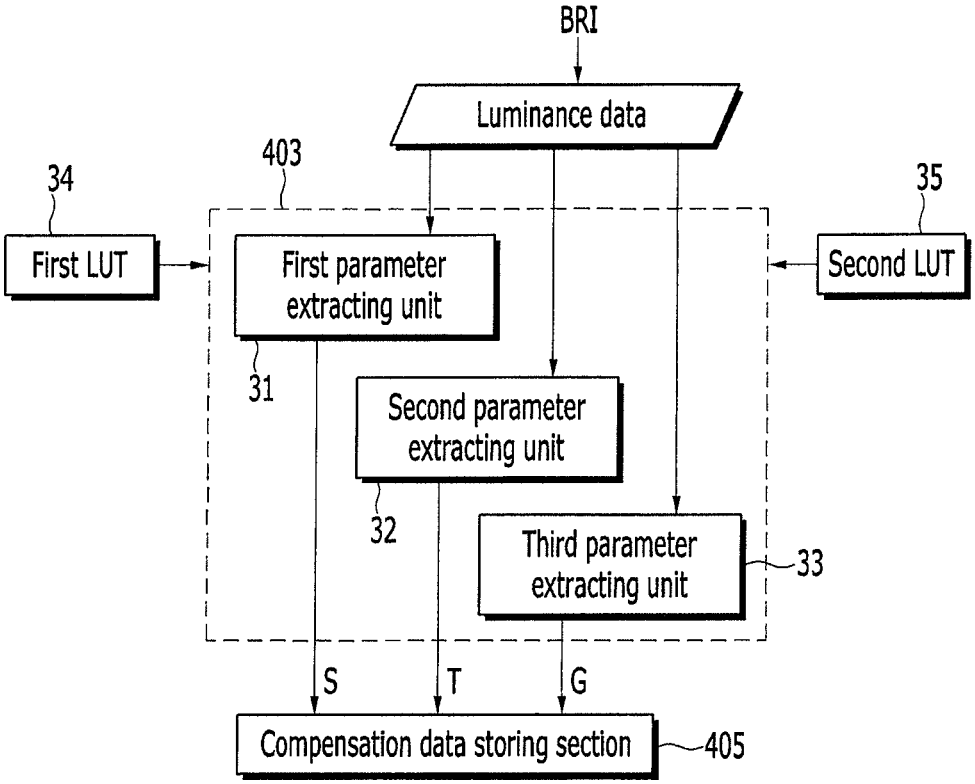
FIG. 3 is a block diagram schematically illustrating the configuration of a luminance information extracting section in the configuration of the image compensation device according to an embodiment of the present invention.

The configuration of the luminance information extracting section 403 according to an embodiment of the present invention is shown in the block diagram of FIG. 3.

The luminance information extracting section 403 receives the brightness information BRI for the pixels from the test image, extracts parameters (e.g., predetermined parameters), using luminance data in the brightness information, and calculates compensation data, using the extracted parameters.

For example, referring to FIG. 3, the luminance information extracting section 403 includes at least three parameter extracting units, that is, a first parameter extracting unit 31, a second parameter extracting unit 32, and a third parameter extracting unit 33. The first to third parameter extracting units receive and calculate luminance data from the input brightness information BRI for the pixels and determine and transmit first to third parameters to the compensation data storing section 405.

The luminance information extracting section 403 can acquire brightness information BRI for the pixels according to at least one grayscale data per pixel when the display 100 displays a test image, corresponding to the test image data signal SDATA. In one embodiment, the brightness information BRI corresponding to the test image data signal inputted to one pixel can be extracted for at least three grayscale values.

In general, the brightness values (luminance values) L according to the image data signal make a gamma curve proportional to the grayscale data of the input image data signal. Arithmetically, when the entire grayscale range is 256 grayscale, the brightness value (luminance value) Li for the grayscale data Di of an input image data can be obtained from the following equation:

Equation 1

$$Li = S \times Lmax \times \left[\frac{(Di - T)}{255}\right]^G$$

where Li is a luminance value obtained from the brightness information BRI of a screen which was actually measured in response to an input data signal transmitted for a pixel (e.g., a predetermined pixel) i in a plurality of input data signals.

Di is a grayscale value of the input data signal corresponding to the pixel i in a plurality of input data signals.

Lmax is the maximum brightness value shown within the corresponding grayscale range of a plurality of input data signals, for example, the brightness value corresponding to the 255 grayscale data, for 256 grayscale range.

T is the grayscale value of the image data signal showing the actual luminance changed by a reason such as threshold voltage deviation of the pixel i.

Therefore, the luminance information extracting section 403 can calculate the first parameter (S in Equation 1), the second parameter (T in Equation 1), and the third parameter (G in Equation 1) from the actually measured brightness information BRI.

S is a parameter relating to the luminous efficiency of the light emitting elements in the pixels, T is a parameter of grayscale data influenced to be changed by threshold voltage change (deviation) of the driving transistors controlling the driving current for light emission of the pixels, and G is a change factor when the brightness change generated by the driving process or technique (way) and an error in driving factors is modeled.

If brightness information BRI of corresponding actual screens is extracted by selecting three input data D1, D2, and D3 corresponding to a certain pixel in input data signals, the luminance values corresponding to the three input data, respectively, are those in the following Equation 2, based on Equation 1:

Equation 2

$$L1 = S \times Lmax \times \left[\frac{(D1 - T)}{255}\right]^G$$

$$L2 = S \times Lmax \times \left[\frac{(D2 - T)}{255}\right]^G$$

$$L3 = S \times Lmax \times \left[\frac{(D3 - T)}{255}\right]^G$$

where L1, L2, and L3 are actual luminance values corresponding to three input data, respectively, and D1, D2, and D3 are three grayscale data corresponding to three grayscale values selected within the grayscale range of input data signals.

For example, the first parameter S and the maximum brightness Lmax in Equation 2 may be constants for the same pixel, such that the second parameter extracting unit 32 of the luminance information extracting section 403 can find the second parameter T, as in the following Equation 3, by solving the three equations in Equation 2:

Equation 3

$$Lr1 = \left(\frac{L1}{L2}\right)^{\frac{1}{G}}$$

$$Lr2 = \left(\frac{L2}{L3}\right)^{\frac{1}{G}}$$

$$T1 = \frac{(D2 \times Lr1 - D1)}{(Lr1 - 1)}$$

$$T2 = \frac{(D3 \times Lr2 - D2)}{(Lr2 - 1)}$$

The second parameter extracting unit 32 can calculate the grayscale data of the second parameter T1 or T2 according to Equation 3.

Further, based on the three grayscale data measured for one pixel, the second parameters calculated from Equation 3 are the same, such that T1=T2 and accordingly, the third parameter extracting unit 33 of the luminance information extracting section 403 can calculate the third parameter G from the following Equation 4:

Equation 4

$$(D2 - D3) \times \left(\frac{L1}{L3}\right)^{\frac{1}{G}} + (D3 - D1) \times \left(\frac{L2}{L3}\right)^{\frac{1}{G}} + (D1 - D2) = 0$$

The first parameter extracting unit 31 of the luminance information extracting section 403 can calculate the first parameter S, as in Equation 5, below, using T and G calculated from Equation 3 and Equation 4. The calculation methods of Equation 4 and Equation 5 are just embodiments and may be changed in other ways on the basis of the three equations in Equation 2.

Equation 5

$$S = \frac{L3}{L\max \times [(D3 - T)/255]^G}$$

Although the first parameter S and the third parameter G may be calculated from Equation 4 and Equation 5, the first parameter extracting unit 31 may extract the first parameter S, using a first look-up table 34 where luminous efficiency of the light emitting elements in the pixels is stored in advance. Further, the third parameter extracting unit 33 may extract the third parameter G from a second look-up table 35 where gamma index information is stored in advance through modeling of the brightness change generated by the driving process or technique (way) and errors in driving factors. Accordingly, even in an embodiment using the first look-up table 34 and the second look-up table 35, the second parameter extracting unit 32 calculates the second parameter T that is a factor for the threshold voltage change of the pixels.

In an embodiment of the present invention as shown in FIG. 3, at least three input data are selected and corresponding actual brightness information is extracted to calculate three parameters for compensation of input data, but the kind and number of parameters are not limited and the luminance information extracting section 403 may be designed to further include a parameter extracting unit that can find parameter variables from brightness information according to input data (e.g., predetermined input data).

The first parameter S, the second parameter T, and the third parameter G calculated by the luminance information extracting section 403 may be transmitted and stored in the compensation data storing section 405.

Figure 4:
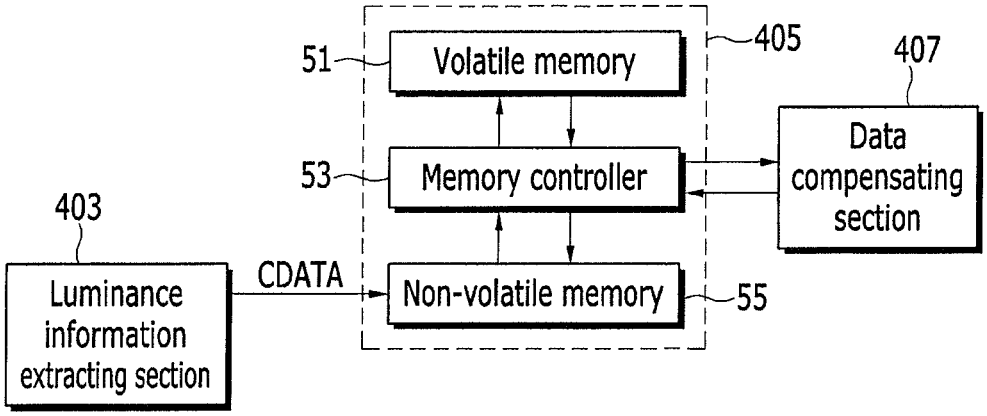
FIG. 4 is a block diagram schematically illustrating the configuration of a compensation data storing section in the configuration of the image compensation device according to an embodiment of the present invention.

FIG. 4 is a block diagram schematically illustrating the configuration of the compensation data storing section 405 in the configuration of the image compensation device according to an embodiment of the present invention.

The compensation data storing section 405 may be composed of a volatile memory 51, a memory controller 53, and a non-volatile memory 55, but is not necessarily limited thereto and the volatile memory 51 may be removed, in accordance with embodiments.

For example, the compensation data storing section 405 receives compensation information CDATA including the brightness information for a test image obtained by the luminance information extracting section 403 and parameters for the pixels for compensation calculated on the basis of the brightness information.

The compensation information CDATA is transmitted and stored in the non-volatile memory 55 of the compensation data storing section 405 and then compensation information can be extracted every time the display device is driven so that the data compensating section 407 can use it.

On the other hand, in an embodiment including the volatile memory 51 that quickly interfaces with the outside to improve the speed of data input/output, the compensation information CDATA can be transmitted and stored in the volatile memory 51 and can be transmitted to the data compensating section 407 for quick real-time data compensation.

The memory controller 53 transmits the stored compensation information CDATA to the data compensating section 407 by controlling the operation of the non-volatile memory 55 or the volatile memory 51. The memory controller 53 may select and control the non-volatile memory 55 or the volatile memory 51 to store compensation information, and may receive compensation data signal DATA2 processed for compensation in response to an image data signal by the data compensating section 407 and store the compensation data signal in the non-volatile memory 55 or the volatile memory 51.

The non-volatile memory 55 or the volatile memory 51 can store parameters for compensation processing of an image in the compensation information CDATA transmitted from the luminance information extracting section 403, in, for example, a look-up table.

The data compensating section 407 receiving the compensation information CDATA stored through the compensation data storing section 405 acquires brightness information and a compensation-related parameter for each pixel and compensates for the external input image signal DATA1. Accordingly, it receives the external input image signal DATA1 through the data input section 401, as in FIG. 2, and generates compensation data signal DATA2 with the luminance compensated, using the compensation information CDATA stored in the compensation data storing section 405, and transmits the compensation data signal DATA2 to the data driver 300.

In more detail, the compensation method for the external input image signal DATA1 performed by the data compensating section 407 may proceed in a compensation order using the second parameter T, the third parameter G, and the first parameter S in the compensation information CDATA. However, the method is not limited to such an embodiment, and compensation may be achieved with only any one of the parameters and the compensation order using the parameters may be changed.

When compensation is performed in the compensation order using the second parameter T, the third parameter G, and the first parameter S, the compensation is performed, as in the following Equation 6, using the second parameter T first:

$$Dc1 = Di + T \qquad \text{Equation 6}$$

Dc1 is compensation data of the input data signal corresponding to a certain pixel i compensated with the second parameter T.

Di is the grayscale data of the input image data of the pixel i.

T is the second parameter calculated from Equation 1 to Equation 3.

Referring to FIG. 6, the compensation data Dc1 is obtained by adding the second parameter that is changed by a reason such as threshold voltage variation of the pixel i to the grayscale data Di of the input image data of the pixel i.

The compensation data Dc1 calculated from Equation 6 is compensated for the third parameter by the following Equation 7.

Equation 7

$$Lt = L\max \times \left[\frac{(Di)}{255}\right]^{Gt} \qquad \text{7-1}$$

-continued $$Li = S \times Lmax \times \left[\frac{(Dc1)}{255}\right]^{G} \quad 7\text{-}2$$

$$Lt = Li \quad 7\text{-}3$$

$$Li = S \times Lmax \times \left[\frac{(Dc2)}{255}\right]^{G} \quad 7\text{-}4$$

$$Dc2 = 255 \times \left(\frac{Lt}{Lmax}\right)^{\frac{1}{G}} \quad 7\text{-}5$$

In general, in an example case with S=1 and Ti=0 in Equation 1, the equation of brightness information corresponding to the pixel i is as that in 7-1.

Lt is a target brightness, and Gt is a gamma value that is the target in the corresponding display panel.

The equation 7-2 is obtained by introducing the data Dc1 compensated (compensated with the second parameter) by Equation 6 into Equation 1.

The target brightness Lt and the actual brightness Li should become the same, as in the equation 7-3, for conversion into the target gamma Gt.

Compensation data Dc2 compensated (compensated with the target gamma) with the third parameter G that makes the target brightness Lt and the actual brightness Li the same can be calculated as in the equations 7-4 and 7-5.

The compensation data Dc2 calculated from Equation 7 is compensated for the first parameter by the following Equation 8:

Equation 8

$$Li = S \times Lmax \times \left[\frac{(Dc2)}{255}\right]^{Gt} \quad 8\text{-}1$$

$$Lt = Lmax \times \left[\frac{(Di)}{255}\right]^{Gt} \quad 8\text{-}2$$

$$Lt = Li \quad 8\text{-}3$$

$$Li = S \times Lmax \times \left[\frac{(Dc3)}{255}\right]^{G} \quad 8\text{-}4$$

$$Dc3 = 255 \times \left(\frac{Lt}{S \times Lmax}\right)^{\frac{1}{G}} \quad 8\text{-}5$$

The equation 8-1 in Equation 8 is an equation for the brightness information of compensation data Dc2 for the third parameter, when the first parameter S is not 1.

When the target brightness Lt is expressed as in the equation 8-2, because the target brightness Lt and the actual brightness Li in 8-2 (equation 8-3) may be equal, compensation data Dc3 compensated with the first parameter S can be calculated as in the equations 8-4 and 8-5.

The drawings referred above and the detailed description of the present invention, provided as examples of the present invention, are used to explain the present invention, not limit meanings or the scope of the present invention described in claims. Therefore, those skilled in the art may easily implement modifications from those described above. Further, those skilled in the art may remove some of the components described herein without deterioration of the performance or may add other components to improve the performance. In addition, those skilled in the art may change the order of the processes of the method described herein, depending on the environment of the process or the equipment. Therefore, the scope of the present invention should be determined by not the embodiments described above, but claims and equivalents.

<Description of Some of the Reference Numerals>

| | |
|---|---|
| 100: Display | 200: Scan driver |
| 300: Data driver | 400: Controller |
| 500: Pixel | |
| 401: Data input section | |
| 403: Luminance information extracting section | |
| 405: Compensation data storing section | |
| 407: Data compensating section | |

What is claimed is:

1. A display device comprising:

a display comprising a plurality of pixels; and a controller configured to:

receive an external input image signal, adjust the external input image signal to compensate for brightness deviations of the pixels, and transmit corresponding image data signals to the pixels, wherein the controller comprises:

a data input section configured to receive the external input image signal and transmit a test image data signal to the pixels, for sensing light emitted by the pixels, through a data driver at a predetermined interval, a luminance information extracting section configured to:

extract brightness information for the pixels after displaying a test image in accordance with the test image data signal, and calculate first, second, and third parameters, using the brightness information, and a data compensating section configured to generate the image data signals by adjusting the external input image signal based on the first, second, and third parameters, wherein the first parameter corresponds to luminous efficiency of light emitting elements of the pixels, the second parameter corresponds to a threshold voltage deviation of driving transistors of the pixels, and the third parameter corresponds to a change in brightness of the display, the change in brightness generated by a driving technique and an error in driving factors of the display, and wherein the luminance information extracting section comprises:

a first parameter extracting unit, a second parameter extracting unit, and a third parameter extracting unit, which are configured to select one of the pixels and calculate the first, second, and third parameters, respectively, based at least partially on the brightness information of the one of the pixels, wherein the second parameter extracting unit is configured to calculate the second parameter based on the brightness information of at least three of the pixels by using an equation, the third parameter extracting unit is configured to calculate the third parameter based on the second parameter, and the first parameter extracting unit is configured to calculate the first parameter based on the second and third parameters, and wherein the equation is as below, $$Li = S \times Lmax \times \left[\frac{(Di - T)}{255}\right]^G$$

wherein Li is an actual luminance value corresponding to an input data Di corresponding to a grayscale value of an external input data signal, S is a parameter relating to the luminous efficiency of a light emitting element, T is a parameter of grayscale data influenced to be changed by a threshold voltage deviation, G is a change factor when a brightness change generated by the driving process or technique and an error in driving factors is modeled, Lmax is a maximum brightness, and 255 is a maximum grayscale value.

2. The display device of claim 1, wherein the brightness information comprises luminance information, color temperature, and color coordinate information corresponding to one of the pixels that displays the test image in response to the test image data signal.

3. The display device of claim 1, wherein the controller further comprises a compensation data storing section configured to store compensation information comprising brightness information of the pixels and the first, second, and third parameters.

4. The display device of claim 3, wherein the compensation data storing section comprises:

a memory configured to:

store the compensation information, transmit the compensation information to a data compensating section, receive an image data signal adjusted by the data compensating section, and store a look-up table of parameters for adjusting image data in the compensation information, and a memory controller configured to control the memory.

5. The display device of claim 1, wherein the data compensating section is configured to adjust the external input image signal by sequentially applying the first parameter, the second parameter, and the third parameter.

6. An image compensation method of a display device, the display device comprising:

a display comprising a plurality of pixels; and a controller configured to receive an external input image signal, compensate for the external input image signal, and transmit corresponding image data signals to each of the pixels, the method comprising:

transmitting a test image data signal to the pixels, for sensing light emitted by the pixels, through a data driver at a predetermined interval;

displaying a test image using the pixels in response to the test image data signal;

selecting a group of the pixels; acquiring brightness information for the group of the pixels displaying the test image;

calculating a first parameter, a second parameter, and a third parameter, using the brightness information; and generating the image data signals by adjusting the external input image signal based on the first, second, and third parameters, wherein the first parameter corresponds to luminous efficiency of light emitting elements of the pixels, the second parameter corresponds to a threshold voltage deviation of driving transistors of the pixels, and the third parameter corresponds to a change in brightness of the display, the change in brightness generated by a driving technique and an error in driving factors of the display, and wherein calculating the first, second, and third parameters comprises:

calculating the second parameter based on the brightness information of at least three of the pixels by using an equation;

calculating the third parameter based on the second parameter; and calculating the first parameter based on the second and third parameters, and wherein the equation is as below, $$Li = S \times Lmax \times \left[\frac{(Di - T)}{255}\right]^G$$

wherein Li is an actual luminance value corresponding to an input data Di corresponding to a grayscale value of an external input data signal, S is a parameter relating to the luminous efficiency of a light emitting element, T is a parameter of grayscale data influenced to be changed by a threshold voltage deviation, G is a change factor when a brightness change generated by the driving process or technique and an error in driving factors is modeled, Lmax is a maximum brightness, and 255 is maximum a grayscale value.

7. The method of claim 6, wherein the brightness information comprises luminance information, color temperature, and color coordinate information corresponding to the group of the pixels that displays the test image in response to the test image data signal.

8. The method of claim 6, further comprising:

storing compensation information comprising the brightness information, the first, second, and third parameters, and the image data signal generated by adjusting the external input image signal.

9. The method of claim 6, further comprising adjusting the external input image signal by sequentially applying the first parameter, the second parameter, and the third parameter.

10. The method of claim 6, wherein the calculating of first, second, and third parameters includes selecting one of the pixels and calculating the second parameter from the brightness information for the selected one of the pixels, calculating the third parameter based on the second parameter, and calculating the first parameter based on the second and third parameters.

* * * * *